US008517373B2

(12) United States Patent
Harada

(10) Patent No.: US 8,517,373 B2
(45) Date of Patent: Aug. 27, 2013

(54) SHEET FEEDER WITH PICKUP ROLLER AND IMAGE FORMING APPARATUS

(75) Inventor: Hiroyuki Harada, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/360,966

(22) Filed: Jan. 30, 2012

(65) Prior Publication Data

US 2012/0193863 A1 Aug. 2, 2012

(30) Foreign Application Priority Data

Jan. 31, 2011 (JP) ..... 2011-018286

(51) Int. Cl.
*B65H 3/06* (2006.01)

(52) U.S. Cl.
USPC ..... 271/117; 271/118

(58) Field of Classification Search
USPC ..... 271/117, 118
See application file for complete search history.

(56) References Cited

U.S. PATENT DOCUMENTS

| | | | | |
|---|---|---|---|---|
| 6,390,463 | B1 * | 5/2002 | Iwago | 271/118 |
| 6,547,235 | B2 * | 4/2003 | Higaki | 271/10.01 |
| 6,991,227 | B2 * | 1/2006 | Kim | 271/10.12 |
| 7,275,741 | B2 * | 10/2007 | Worley et al. | 271/117 |
| 7,422,205 | B2 * | 9/2008 | Akiyama et al. | 271/118 |
| 7,506,867 | B2 * | 3/2009 | Lee et al. | 271/117 |
| 7,595,916 | B2 * | 9/2009 | Morimoto et al. | 358/474 |
| 7,717,415 | B2 * | 5/2010 | Kim et al. | 271/110 |
| 8,016,284 | B2 | 9/2011 | Tanaka et al. | |
| 8,061,705 | B1 * | 11/2011 | Su et al. | 271/117 |
| 8,231,122 | B2 * | 7/2012 | Tu | 271/121 |
| 8,292,289 | B2 * | 10/2012 | Kotaka et al. | 271/117 |
| 2007/0001374 | A1 * | 1/2007 | Lee | 271/117 |

FOREIGN PATENT DOCUMENTS

| | | |
|---|---|---|
| JP | 5-147754 | 6/1993 |
| JP | 2005-15206 | 1/2005 |
| JP | 2006-103840 | 4/2006 |
| JP | 2007-230782 | 9/2007 |

* cited by examiner

*Primary Examiner* — Kaitlin Joerger
(74) *Attorney, Agent, or Firm* — Gerald E. Hespos; Michael J. Porco; Matthew T. Hespos

(57) ABSTRACT

A sheet feeder includes a pickup roller for feeding a sheet on a tray toward a predetermined processing position, an arm member rotatably supporting the pickup roller, a rotary shaft supported on the housing to be rotatable about an axis thereof, a coupling member for coupling the arm member and the rotary shaft, a pivoting mechanism for pivoting the arm member via the rotary shaft so that the pickup roller shifts its position between a feeding position and a retracted position, and a controller for controlling the operation of the pivoting mechanism. The controller controls the arm member to pivot in such a direction that the pickup roller moves toward the retracted position when a sheet is placed on the tray.

8 Claims, 11 Drawing Sheets

SHEET FEEDER WITH PICKUP ROLLER AND IMAGE FORMING APPARATUS

This application is based on and claims the benefit of priority from Japanese Patent application No. 2011-018286 filed in Japan Patent Office on Jan. 31, 2011, the contents of which are hereby incorporated by reference.

BACKGROUND

The present disclosure relates to a sheet feeder for feeding a sheet to a predetermined processing position and an image forming apparatus with this sheet feeder as an automatic document feeder.

An image forming apparatus for forming an image on a recording sheet based on a document image on a document sheet includes an apparatus main body for performing image formation, an automatic document feeder and an image reading unit. A document sheet set on a document tray of the automatic document feeder is conveyed toward an image reading position of the image reading unit and a document image thereof is optically read. In an image forming apparatus using an electrophotographic process, a photoconductive drum is charged in advance and a laser beam modulated according to image data of the document image is irradiated to the surface of this drum to form an electrostatic latent image. A developed toner image is transferred to a recording sheet and then fixed to the recording sheet.

The automatic document feeder includes a pickup roller for feeding a document sheet set on the document tray. This pickup roller is pivotally supported on an arm member, retracted to a position above a sheet conveyance path (retracted position) before the document sheet is set on the document tray and lowered to come into contact with the upper surface of the document sheet and feed this document sheet (feeding position) after the document sheet is set. In such an automatic document feeder, it is known to change the posture of the pickup roller between the retracted position and the feeding position by coupling a drive shaft of a feed roller and a roller holding member for holding the pickup roller by a coiled spring (prior art 1). The coiled spring is mounted on the drive shaft with a constant holding force and includes an engaging portion with the roller holding member and transmits a torque of the drive shaft to the roller holding member to pivot the roller holding member. On the other hand, when the retracted position or the feeding position is reached and the pivotal movement of the roller holding member is prevented, the holding force of the coiled spring on the drive shaft is released and the coiled spring and the drive shaft are in a slip state. Accordingly, the torque of the drive shaft is not transmitted to the roller holding member. Further, there is also known an apparatus for performing a standby operation to move a pickup roller when an automatic document feeder is turned on to keep the pickup roller on standby at a predetermined position (prior art 2).

A user of the image forming apparatus often aligns document sheets using the upper surface of a housing of the automatic document feeder when setting the document sheets on the automatic document feeder. Vibration produced on the housing by this aligning operation could lower the pickup roller at the retracted position. This depends on the fact that the pickup roller is maintained at the retracted position with a relatively small force by a coupling member such as the coiled spring as in the prior art 1. If the pickup roller is lowered, a space where the document sheets can be set becomes narrower in a height direction and there is a possibility of problems that document sheets are rolled up when being set and the leading ends of the document sheets are less likely to be aligned in a sheet feeding direction to cause a multi-feed problem.

In the apparatus of the prior art 1, the problem of lowering the pickup roller can be solved if a coiled spring with a large holding force is used. However, a torque required to pivot the arm member increases, leading to a necessity to increase the capacity of a motor for pivoting the arm member. Further, in the apparatus of the prior art 2, the pickup roller is kept on standby at the predetermined position when the automatic document feeder is turned on, but the problem of lowering the pickup roller after the automatic document feeder is turned on cannot be handled.

An object of the present disclosure is to provide a sheet feeder and an image forming apparatus in which a sheet to be fed can be reliably set on a tray and fed to a predetermined position without problem.

SUMMARY

To achieve above object, one aspect of the present disclosure is directed to a sheet feeder, including a housing, a tray, a pickup roller, an arm member, a rotary shaft, a coupling member, a pivoting mechanism, a controller and a detector. The tray is attached to the housing and on which a sheet to be fed is to be placed. The pickup roller is for feeding a sheet on the tray to a predetermined processing position. The arm member is supported on the housing to be pivotal in a predetermined range and, on the other hand, rotatably supports the pickup roller. The rotary shaft is supported on the housing to be rotatable about an axis thereof. The coupling member is a member for coupling the arm member and the rotary shaft and transmits a torque of the rotary shaft to the arm member in a range where a pivotal movement of the arm member is not restricted while not transmitting the torque of the rotary shaft to the arm member in a state where the pivotal movement of the arm member is restricted. The pivoting mechanism is a mechanism for pivoting the arm member via the rotary shaft so that the pickup roller shifts its position between a feeding position where it is in contact with the upper surface of a sheet on the tray and a retracted position spaced upward from the upper surface of the sheet. The controller is for controlling the operation of the pivoting mechanism. The detector detects placement of a sheet on the tray.

The controller controls the arm member to pivot in such a direction that the pickup roller moves toward the retracted position when the detector detects placement of a sheet.

Further, another aspect of the present disclosure is directed to an image forming apparatus, including an image reading unit for optically reading a document image of a document sheet; an image forming unit for performing an image forming process for the document image on a recording sheet; and an automatic document feeder for automatically feeding the document sheet to the image reading unit; wherein this automatic document feeder has the construction of the above sheet feeder.

DETAILED DESCRIPTION

Figure 1:
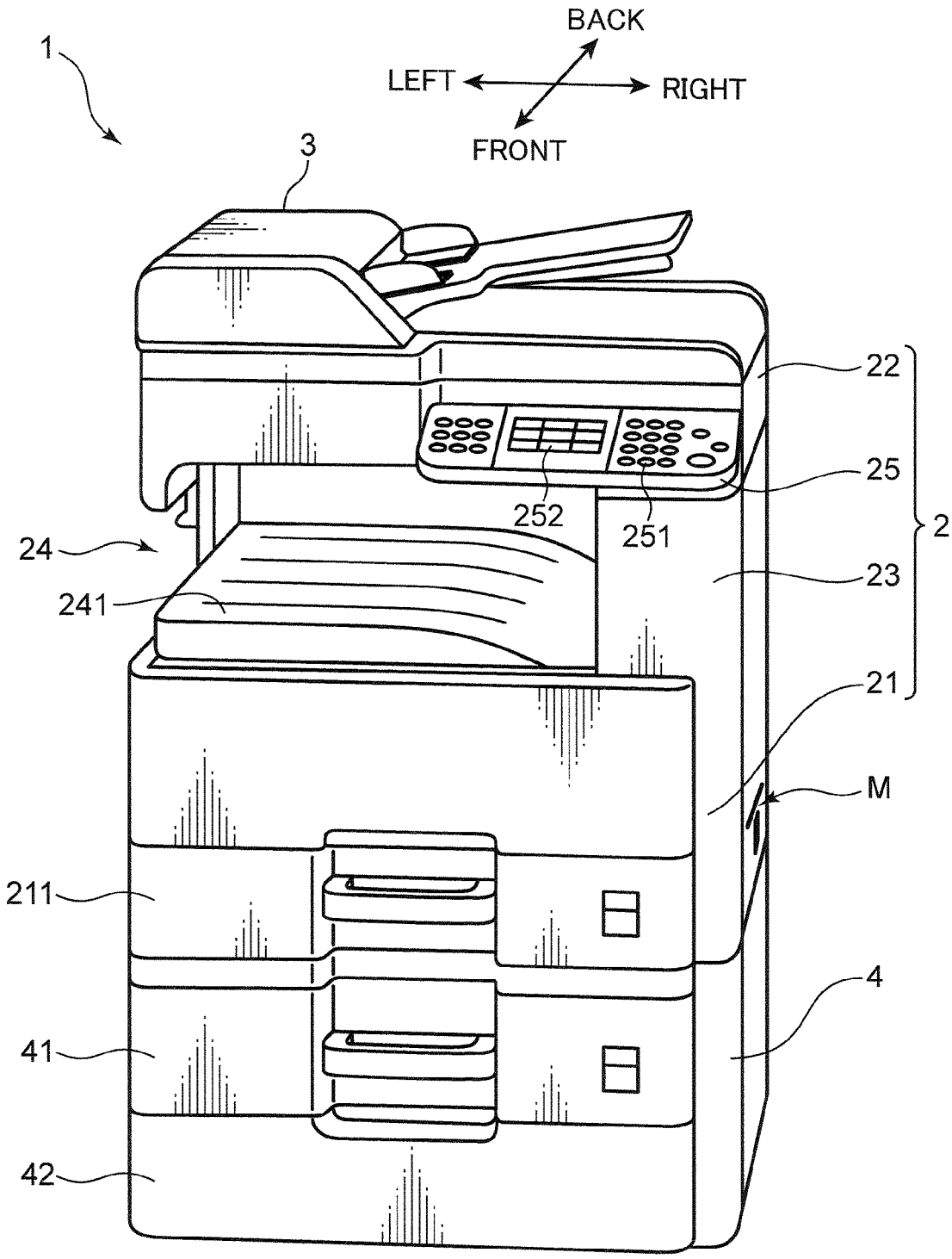
FIG. 1 is a perspective view showing the external appearance of an image forming apparatus according to one embodiment of the present disclosure.
Figure 2:
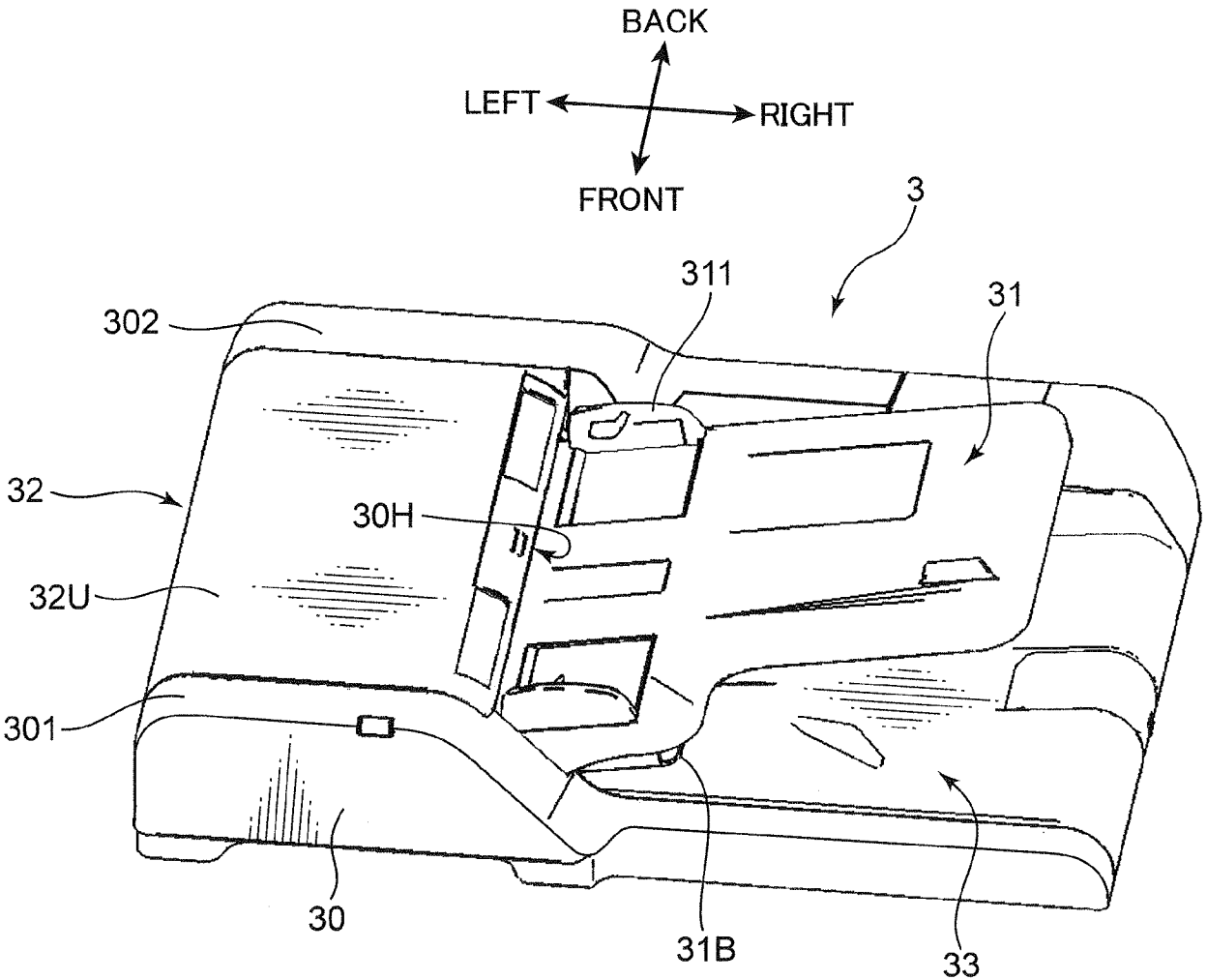
FIG. 2 is a perspective view showing the external appearance of an automatic document feeder.
Figure 3:
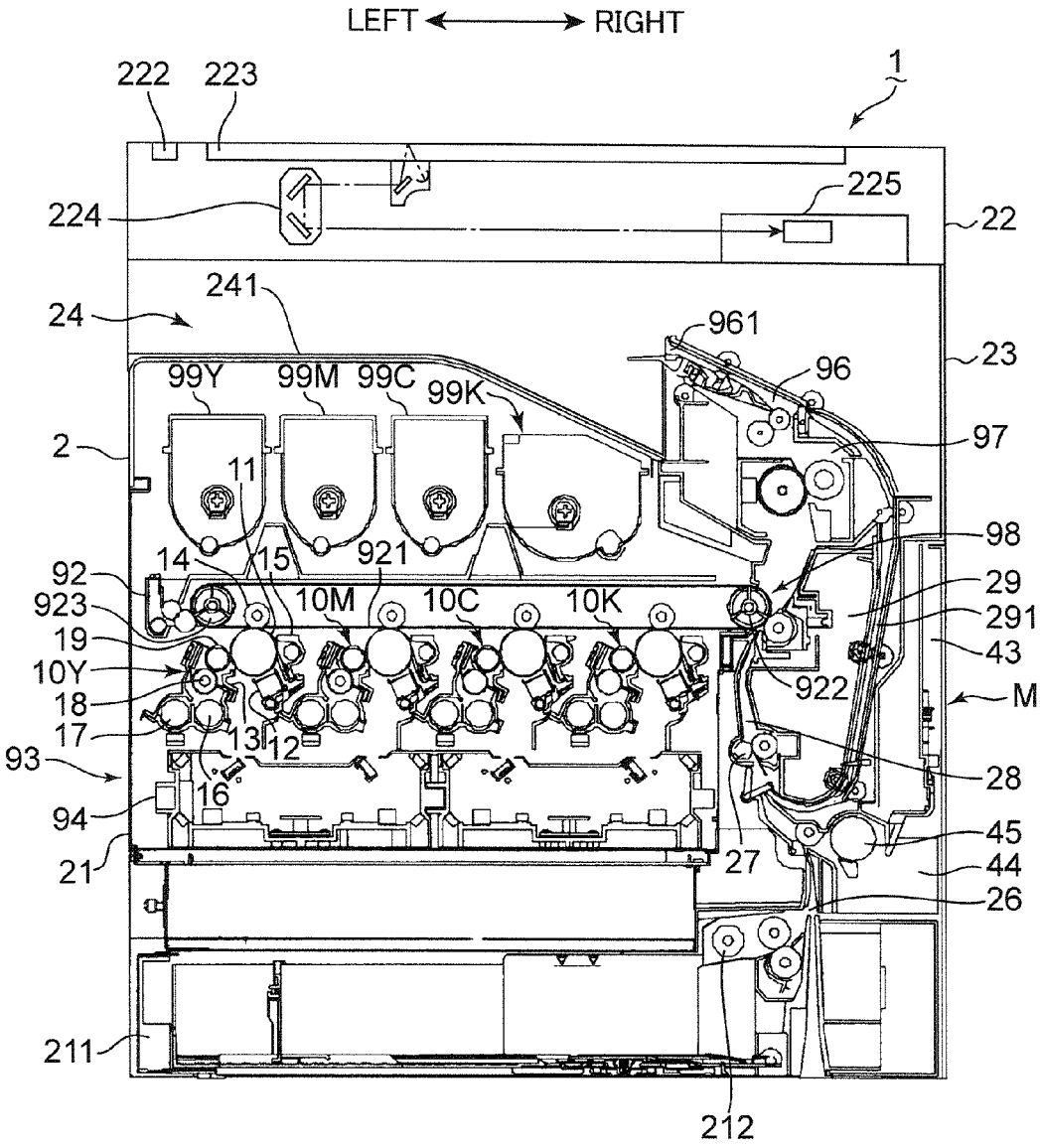
FIG. 3 is a sectional view showing the internal structure of the image forming apparatus.

Hereinafter, an embodiment of the present disclosure is described with reference to the drawings. FIG. 1 is a perspective view showing the external appearance of an image forming apparatus 1 according to one embodiment of the present disclosure, FIG. 2 is a perspective view showing the external appearance of an automatic document feeder 3, and FIG. 3 is a sectional view showing the internal structure of the image forming apparatus 1. Although a copier of an internal discharge type is illustrated as the image forming apparatus 1 here, the image forming apparatus may be a printer, a facsimile machine, or a complex machine provided with these functions.

The image forming apparatus 1 includes an apparatus main body 2 having a substantially rectangular parallelepipedic housing structure and including an internal space (internal discharging portion 24), the automatic document feeder 3 arranged on the upper surface of the apparatus main body 2 and an extension sheet feeder unit 4 assembled at a lower side of the apparatus main body 2.

The apparatus main body 2 performs an image forming process on a sheet. The apparatus main body 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. Various devices for image formation are housed in the lower housing 21, and various devices for optically reading a document image are housed in the upper housing 22. An internal space enclosed by the lower housing 21, the upper housing 22 and the coupling housing 23 serves as an internal discharge portion 24 capable of storing a sheet after image formation. The coupling housing 23 is arranged at a side of the right surface of the apparatus main body 2 and provided with a discharge opening 961 for discharging a sheet to the internal discharge portion 24.

The internal space utilized as the internal discharge portion 24 is exposed to the outside at the front surface and the left surface of the apparatus main body 2. A user can take out a sheet after image formation from the internal discharge portion 24 by inserting his or her hand through these exposed parts. A bottom surface 241 of the internal space is defined by the upper surface of the lower housing 21, and sheets discharged from the discharge opening 961 are stacked thereon.

An operation panel unit 25 is provided to project from the front surface of the upper housing 22. The operation panel unit 25 is provided with operation keys 251 including a numerical keypad and a start key, an LCD touch panel 252, etc. and receives input of various operation instructions from the user. The user can input the number of sheets to be printed, print density, etc. by means of the operation panel unit 25.

A sheet cassette 211 for storing sheets on which an image forming process is to be performed is mounted in the lower housing 21. The extension sheet feeder unit 4 also includes sheet cassettes 41, 42 for storing recording sheets on which the image forming process is to be performed. These sheet cassettes 211, 41 and 42 are provided for automatic sheet feeding and a large number of recording sheets can be stored according to sizes. Further, the sheet cassettes 211, 41 and 42 can be withdrawn forward from the front surface of the lower housing 21 or the extension sheet feeder unit 4. Note that only the sheet cassette 211 of the lower housing 21 is drawn in FIG. 3.

A multi-tray unit M enabling the user to manually feed a sheet is mounted on the right surface of the apparatus main body 2. The multi-tray unit M includes a feed tray 43, on which a recording sheet to be manually fed is to be placed, and a feeding unit 44 for feeding the recording sheet to an image forming station in the lower housing 21. The feed tray 43 is openably and closably mounted on the lower housing 21 at a lower end portion thereof and is in a closed state when not used. The user opens the feed tray 43 and places a recording sheet thereon in the case of manually feeding the sheet.

The automatic document feeder 3 is rotatably mounted on the rear side of the upper surface of the apparatus main body 2. Note that this automatic document feeder 3 is not shown in FIG. 3. The automatic document feeder 3 automatically feeds a document sheet to be copied toward a predetermined document reading position (position where a first contact glass 222 is mounted) in the apparatus main body 2. On the other hand, when the user manually places a document sheet on a predetermined document reading position (arrangement position of a second contact glass 223), the automatic document feeder 3 is opened upward.

With reference to FIG. 2, the automatic document feeder includes a main housing 30 (housing), a document feed tray 31 (tray), a document conveying unit 32, a document discharge tray 33 and a document reversing tray 31B. The main housing 30 is a housing for housing various mechanisms provided in the automatic document feeder 3 and includes a front wall portion 301 and a rear wall portion 302 raised upward at the left side where the document conveying unit 32 is housed and a substantially flat low-level part on the right side.

The document feed tray 31 is a tray on which a document sheet to be fed to the image reading position is to be placed, and attached to the main housing 30 in such a manner so as to extend from a feed opening 30H of the main housing 30. The document feed tray 31 includes a pair of cursors 311 for aligning the width of a placed document sheet.

The document conveying unit 32 includes a conveyance path and a conveying mechanism for conveying a document sheet on the document feed tray 31 to the document discharge tray 33 via the image reading position. The document conveying unit 32 includes an upper cover unit 32U fitted in an opening between the front wall portion 301 and the rear wall portion 302 of the main housing 30. These are described in detail later based on FIG. 4, etc.

The document discharge tray 33 is a tray to which a document sheet is discharged after a document image thereof is optically read. The upper surface of the low-level part on the right side of the main housing 30 serves as the document discharge tray 33. The document reversing tray 31B is a tray to which a document sheet is temporarily discharged in reading the document sheet including document images on both sides.

Next, the internal construction of the apparatus main body 2 is described based on FIG. 3. Toner containers 99Y, 99M, 99C and 99K, an intermediate transfer unit 92, an image forming station 93, an exposure unit 94 and the above sheet cassette 211 are housed in this order from top in the lower housing 21.

The image forming station 93 includes four image forming units 10Y, 10M, 10C and 10K for forming toner images of yellow (Y), magenta (M), cyan (C) and black (K) to form a full-color toner image. Each of the image forming units 10Y, 10M, 10C and 10K includes a photoconductive drum 11, and a charger 12, a developing device 13, a primary transfer roller 14 and a cleaner 15 arranged around the photoconductive drum 11.

The photoconductive drum 11 rotates about its shaft and has an electrostatic latent image and a toner image formed on its circumference surface. A photoconductive drum using an amorphous silicon (a-Si) containing material can be used as the photoconductive drum 11. The charger 12 uniformly charges the circumferential surface of the photoconductive drum 11. The circumferential surface of the photoconductive drum 11 after charging is exposed to light by the exposure unit 94 to form an electrostatic latent image.

The developing device 13 supplies toner to the circumferential surface of the photoconductive drum 11 to develop an electrostatic latent image formed on the photoconductive drum 11. The developing device 13 is for a two-component developer and includes agitating rollers 16, 17, a magnetic roller 18 and a developing roller 19. The agitating rollers 16, 17 charge the toner by conveying the two-component developer in a circulating manner while agitating it. The two-component developer is carried on the circumferential surface of the magnetic roller 18, and the toner is transferred to the circumferential surface of the developing roller 19 due to a potential difference between the magnetic roller 18 and the developing roller 19, whereby a toner layer is formed and carried on the circumferential surface of the developing roller 19. The toner on the developing roller 19 is supplied to the circumferential surface of the photoconductive drum 11, thereby developing the electrostatic latent image.

The primary transfer roller 14 forms a nip portion together with the photoconductive drum 11 with an intermediate transfer belt 921 of the intermediate transfer unit 92 sandwiched therebetween, and primarily transfers the toner image on the photoconductive drum 11 to the intermediate transfer belt 921. The cleaner 15 cleans the circumferential surface of the photoconductive drum 11 after the transfer of the toner image.

The yellow toner container 99Y, the magenta toner container 99M, the cyan toner container 99C and the black toner container 99K are respectively for storing toners of the respective colors, and supply the toners of the respective colors to the developing devices 13 of the image forming units 10Y, 10M, 10C and 10K corresponding to the respective YMCK colors via unillustrated supply paths.

The exposure unit 94 includes a light source and various optical components such as a polygon mirror, a reflecting mirror and a deflecting mirror, and irradiates the circumferential surfaces of the photoconductive drums 11 provided in the respective image forming units 10Y, 10M, 10C and 10K with beams based on image data of a document image to form electrostatic latent images.

The intermediate transfer unit 92 includes the intermediate transfer belt 921, a drive roller 922 and a driven roller 923. Toner images from a plurality of photoconductive drums 11 are superimposed on the intermediate transfer belt 921 (primary transfer). The superimposed toner images are secondarily transferred to a recording sheet supplied from the sheet cassette 211 in a secondary transfer unit 98. The drive roller 922 and the driven roller 923 for rotationally driving the intermediate transfer belt 921 are rotatably supported on the lower housing 21.

The sheet cassette 221 (41, 42) stores a sheet stack composed of a plurality of recording sheets stacked one over another. A pickup roller 212 is arranged above the right end of the sheet cassette 211. By driving the pickup roller 212, the uppermost recording sheet of the sheet stack in the sheet cassette 211 is picked up one by one and conveyed to a carry-in conveyance path 26. On the other hand, a recording sheet manually placed on the feed tray 43 is conveyed to the carry-in conveyance path 26 by driving a feed roller 45 of the feeding unit 44.

A sheet conveyance path 28 extending up to the discharge opening 961 via the secondary transfer unit 98, a fixing unit 97 and a discharge unit 96 to be described later is provided downstream of the carry-in conveyance path 26. An upstream part of the sheet conveyance path 28 is formed between an inner wall formed in the lower housing 21 and an inner wall forming the inner side surface of a reversing unit 29. Note that an outer side surface of the reversing unit 29 constitutes one surface of a reversing conveyance path 291 for reversing and conveying a sheet at the time of duplex printing. A pair of registration rollers 27 is arranged at a position of the sheet conveyance path 28 upstream of the secondary transfer unit 98. The sheet is temporarily stopped by the pair of registration rollers 27 and fed to the secondary transfer unit 98 at a predetermined timing for image transfer after a skew correction.

The fixing unit 97 and the discharge unit 96 are housed in the coupling housing 23. The fixing unit 97 includes a fixing roller and a pressure roller and performs a fixing process by heating and pressing a recording sheet having a toner image secondarily transferred in the secondary transfer unit 98. The recording sheet with the fixed color image is discharged from the discharge opening 961 toward the internal discharge portion 24 by the discharge unit 96 arranged downstream of the fixing unit 97.

The first contact glass 222 and the second contact glass 223 are embedded in the upper surface of the upper housing 22. The first contact glass 222 is provided for reading a document sheet automatically fed by the automatic document feeder 3. The second contact glass 223 is provided for reading a manually placed document sheet.

A scanning mechanism 224 and an image pickup device 225 for optically reading document information of a document sheet are housed in the upper housing 22. The scanning mechanism 224 includes a light source, a moving carriage, a reflecting mirror, etc. and introduces reflected light from a document to the image pickup device 225. The image pickup device 225 photoelectrically converts the reflected light into an analog electrical signal. The analog electrical signal is input to the exposure unit 94 after being converted into a digital electrical signal in an A/D conversion circuit (not shown).

Figure 4:
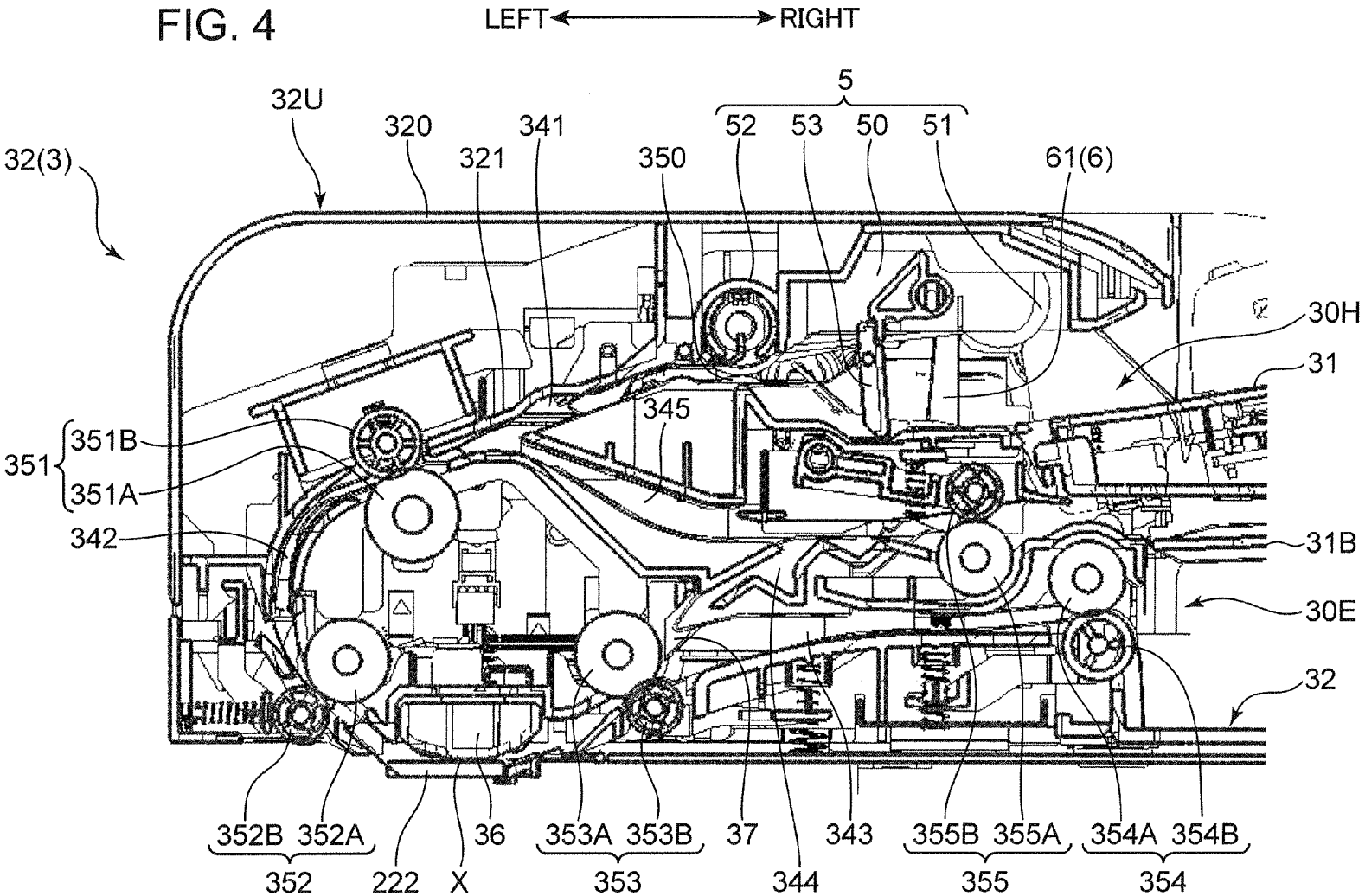
FIG. 4 is a sectional view of an essential part of the automatic document feeder.
Figure 5:
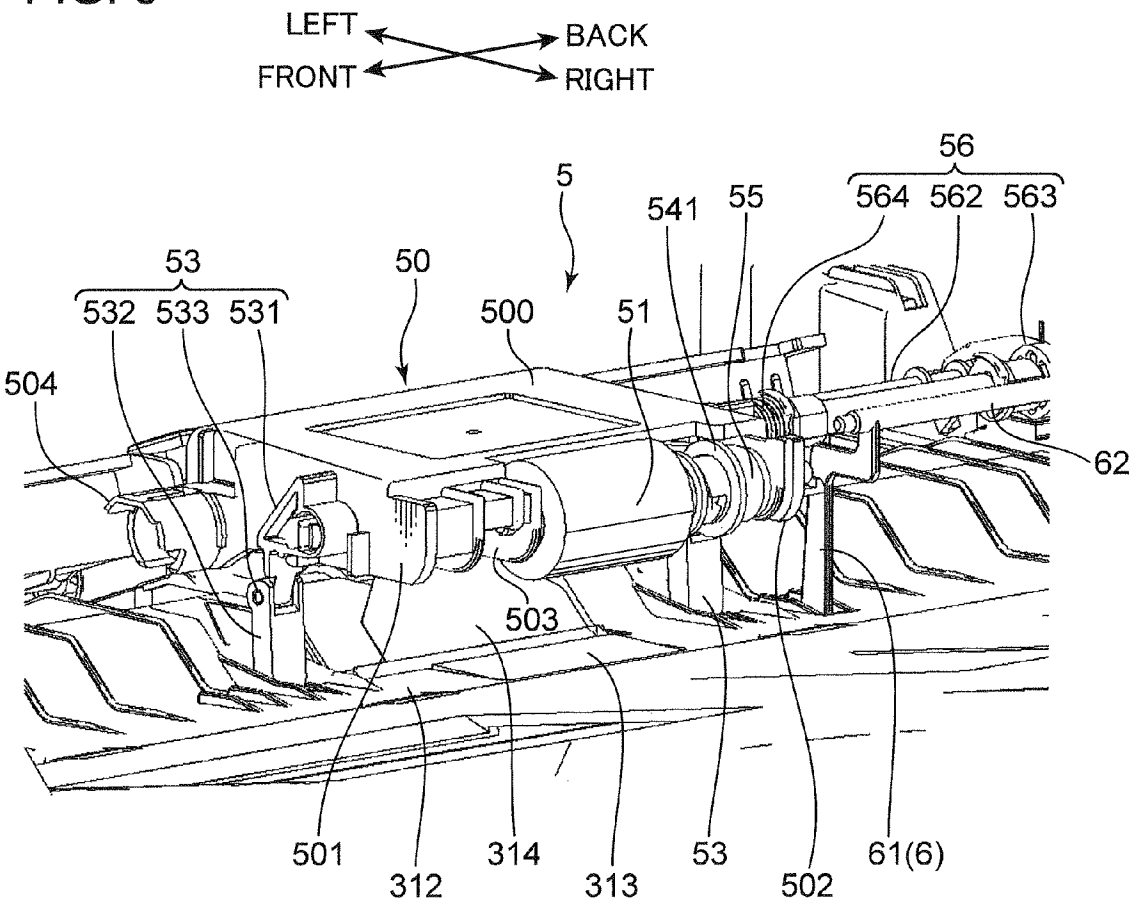
FIG. 5 is a perspective view enlargedly showing a part of a document feeder unit of the automatic document feeder.
Figure 6:
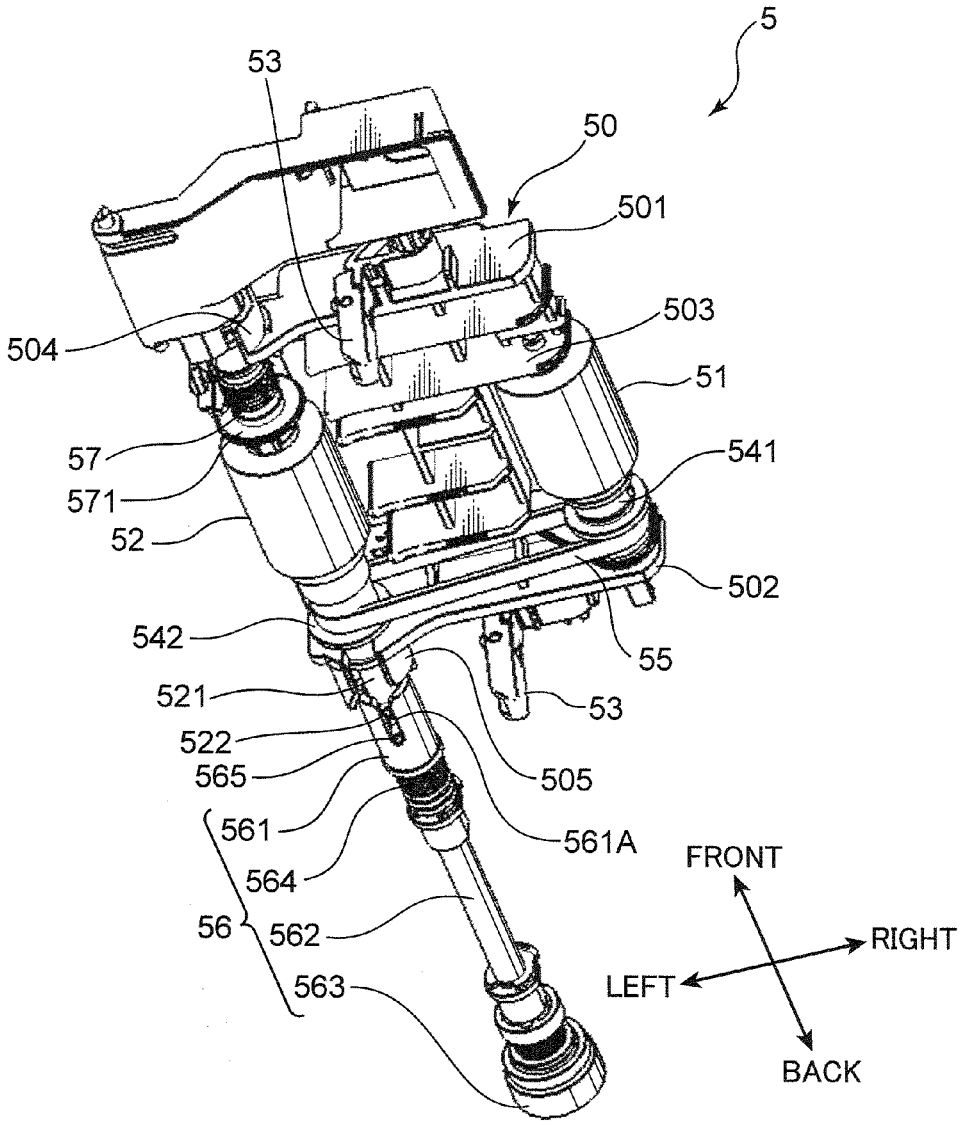
FIG. 6 is a perspective view of the document feeder unit when viewed from below.
Figure 7:
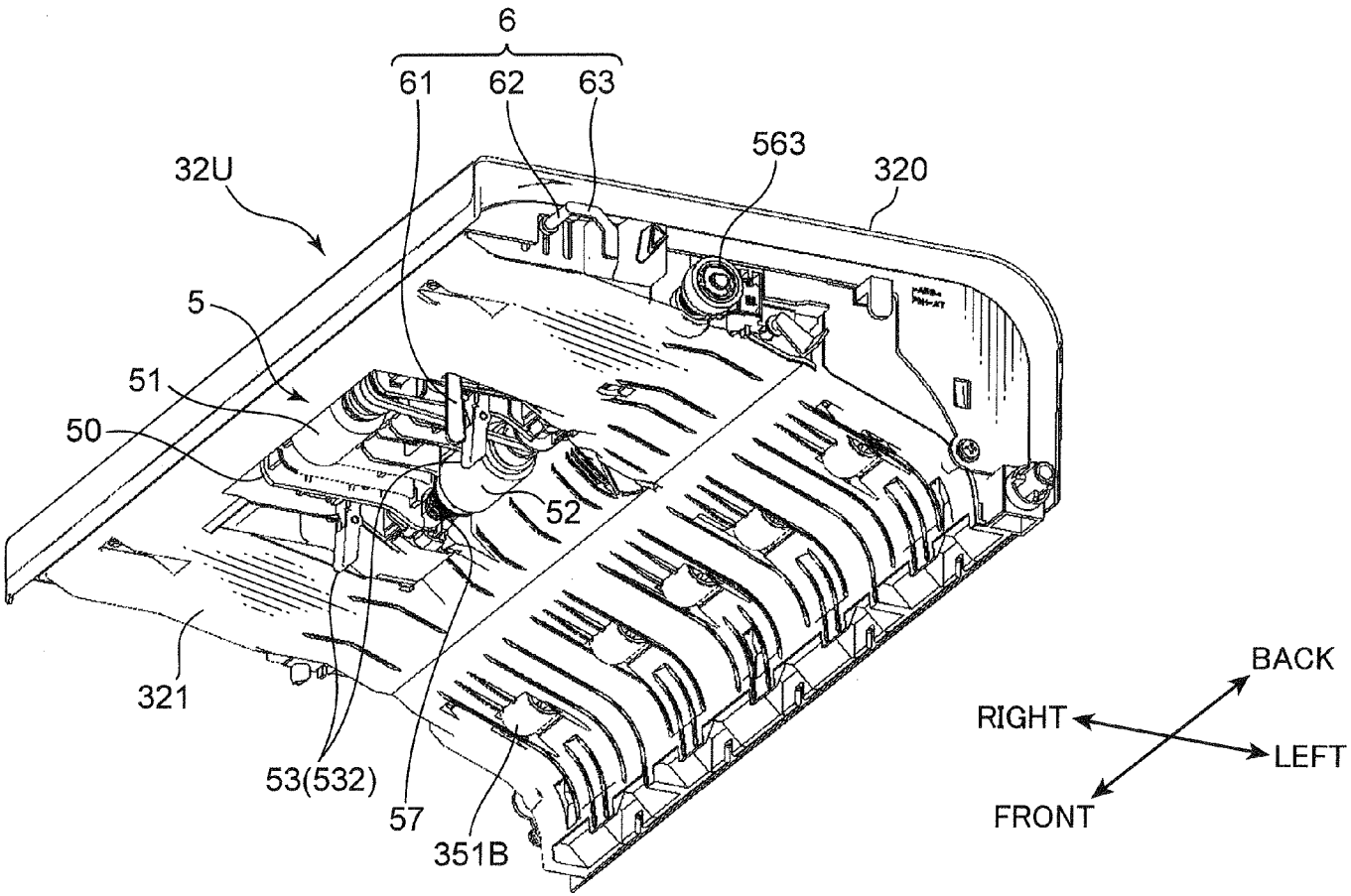
FIG. 7 is a perspective view of an upper cover unit of the automatic document feeder when viewed from below.

Next, the internal structure of the automatic document feeder 3 is described in detail based on FIGS. 4 to 8. FIG. 4 is a sectional view showing an essential part (document conveying unit 32) of the automatic document feeder 3. The document conveying unit 32 includes first to fifth conveyance paths 341 to 345 constituting a conveyance route for document sheets, first to fifth conveyor roller pairs 351 to 355 arranged at suitable positions of these first to fifth conveyance paths 341 to 345, a document feeder unit 5 for feeding a document sheet placed on the document feed tray 31 into the document conveying unit 32 and a detecting member 6 (detector) for detecting placement of the document sheet on the document feed tray 31. FIG. 5 is a perspective view enlargedly showing the document feeder unit 5, FIG. 6 is a perspective view of the document feeder unit 5 when viewed from below, FIG. 7 is a perspective view of the upper cover unit 32U described above when viewed from below, and FIG. 8 is a perspective view of the upper cover unit 32U with a guide member 321 on an inner surface removed.

The first, second and third conveyance paths 341, 342 and 343 constitute a U-shaped conveyance path extending from the above feed opening 30H to a discharge opening 30E, through which a document sheet is discharged to the document discharge tray 33, via a reading position X where a document image is optically read. On the other hand, the fourth and fifth conveyance paths 344, 345 are switchback conveyance paths used to reverse a document sheet in reading the document sheet having document images on both sides.

The first conveyance path 341 is a conveyance path which is continuous with the document feed tray 31 and extends leftward and slightly downward from the feed opening 30H and in which a document sheet fed from the document feeder unit 5 first passes. An upper conveying surface of this first conveyance path 341 is defined by the guide member 321 (see FIG. 7) of the upper cover unit 32U. The second conveyance path 342 is an arcuate conveyance path extending from the downstream end of the first conveyance path 341 to the document reading position X facing the first contact glass 222. One conveying surface of this second conveyance path 342 is also defined by the guide member 321 of the upper cover unit 32U. The third conveyance path 343 is a conveyance path extending rightward and slightly upward from the position facing the first contact glass 222 to the discharge opening 30E. Note that a contact guide 36 to bring a document sheet into sliding contact with the first contact glass 222 is arranged at the position facing the first contact glass 222.

The fourth conveyance path 344 is a conveyance path branched off from the third conveyance path 343 and extending upward and rightward. A switching lever 37 is arranged at a position where the third and fourth conveyance paths 343, 344 are branched. The switching lever 37 guides a document sheet to the third conveyance path 343 in the case of normal one-side reading while guiding a document sheet to the fourth conveyance path 344 when the document sheet having one side read needs to be reversed upside down in the case of reading both sides of the document sheet. The fifth conveyance path 345 is a substantially horizontal conveyance path communicating with the fourth conveyance path 344, the first conveyance path 341 and the document reversing tray 31B and used to receive the document sheet to be reversed upside down from the fourth conveyance path 344 and switch back and convey it to the first conveyance path 341.

Each of the first, second, third, fourth and fifth conveyor roller pairs 351, 352, 353, 354 and 355 is composed of a combination of a drive roller 351A, 352A, 353A, 354A or 355A for generating a rotational driving force for conveying the document sheet and a driven roller 351B, 352B, 353B, 354B or 355B held in contact with the drive roller to be driven and rotated.

The first conveyor roller pair 351 is arranged between the first and second conveyance paths 341, 342 and feeds a document sheet toward the largely curved second conveyance path 342. The second conveyor roller pair 352 is arranged right upstream of the document reading position X and feeds the document sheet to the document reading position X. The third conveyor roller pair 353 is arranged right downstream of the document reading position X and feeds the document sheet after image reading to the third or fourth conveyance path 343 or 344. The fourth conveyor roller pair 354 is arranged near the discharge opening 30E and discharges the document sheet toward the document discharge tray 33. The fifth conveyor roller pair 355 is composed of a pair of rollers which can rotate in forward and reverse directions, arranged in the fifth conveyance path 345, and switches back and conveys the document sheet utilizing the document reversing tray 31B.

Figure 8:
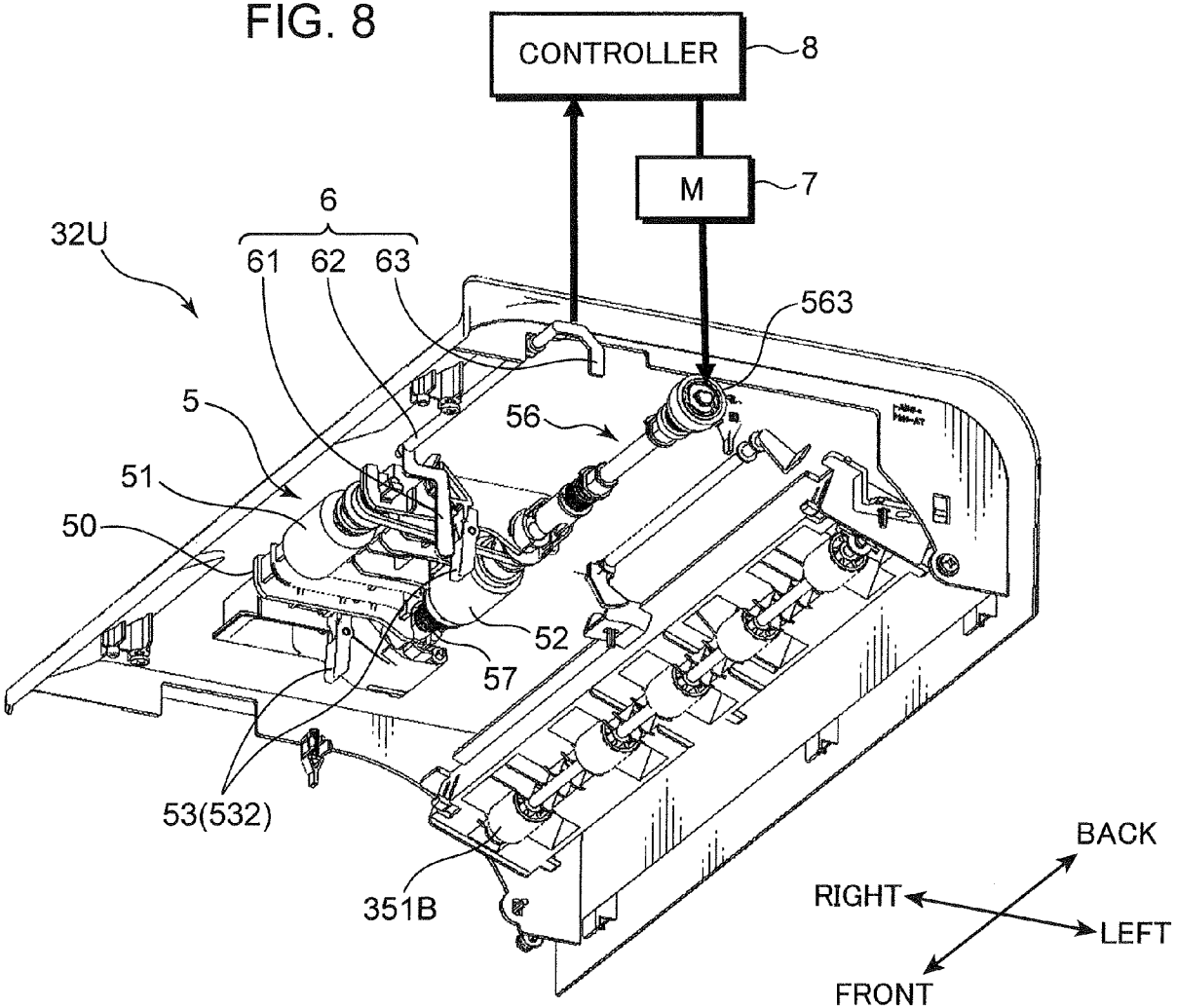
FIG. 8 is a perspective view showing a state where a guide member on an inner surface is removed from the upper cover unit of FIG. 7.

The document feeder unit 5 includes a pickup roller 51, a document feed roller 52 arranged downstream of the pickup roller in a sheet conveying direction, a pair of stoppers 53 for restricting the leading end of a document sheet placed on the document discharge tray 31 in the feeding direction, a holder 50 (arm member) for holding these members, a driving mechanism 56 (pivoting mechanism) for pivoting the holder 50, and a torsion coil spring 57 (coupling member) which couples the holder 50 and a rotary shaft 521 of the document feed roller 52. As shown in FIGS. 7 and 8, the document feeder unit 5 is mounted in the upper cover unit 32U. The automatic document feeder 3 further includes a motor 7 (part of the driving mechanism) for feeding a rotational driving force in a forward or reverse direction to the driving mechanism 56 and a controller 8 (controller) for controlling the rotational motion of this motor 7.

The holder 50 is a box-shaped member including an upper plate 500 in the form of a flat plate, a front plate 501, a rear plate 502 and a middle plate 503 made of rib members integral to the upper plate 500. A front tubular portion 504 and a rear tubular portion 505, which are coaxially arranged, project from the front plate 501 and the rear plate 502. The holder 50 pivots about tube centers of the front and rear tubular portions 504, 505.

The pickup roller 51 has a torque given thereto to rotate about its axis and feeds document sheets placed on the document feed tray 31 one by one to the document conveying unit 32 (first conveyance path 341). A rotary shaft of the pickup roller 51 is rotatably supported at the right sides of the rear and middle plates 502, 503. The pickup roller 51 shifts its position between a feeding position (lower position) where it is in contact with the upper surface of the document sheet on the document feed tray 31 and a retracted position (upper position) where it is spaced upward from the upper surface of the document sheet by a pivotal movement of the holder 50 about the tube centers of the front and rear tubular portions 504, 505 (described in detail later based on FIGS. 9 to 11).

As shown in FIG. 5, a separation pad 313 is arranged at a position facing the pickup roller 51 at a downstream end 312 of the document feed tray 31. When the pickup roller 51 is at the feeding position, a nip portion is formed between the pickup roller 51 and the separation pad 313.

The document feed roller 52 conveys one document sheet fed from the pickup roller 51 further to the first conveyance path 341. The rotary shaft 521 of the document feed roller 52 is rotatably supported by the front and rear plates 501, 502 of the holder 50. In feeding a document sheet, a rotational driving force is given to the rotary shaft 521 and the document feed roller 52 rotates. Note that, as shown in FIG. 4, a driven roller 350 is arranged to face this document feed roller 52 in the main housing. The front and rear tubular portions 504, 505 of the holder 50 described above are mounted rotatably about the axis of this rotary shaft 521. That is, the axial center of the rotary shaft 521 and the tube centers of the front and rear tubular portions 504, 505 are coaxial, wherefore the document feed roller 52 is not vertically moved even if the holder 50 pivots and constantly forms the sheet feeding nip portion together with the driven roller 350.

The pair of stoppers 53 are respectively so mounted on the outer surfaces of the front and rear plates 501, 502 of the holder 50 as to be located substantially in the center between the pickup roller 51 and the document feed roller 52. Each stopper 53 includes an engaging portion 531 to be engaged with the holder 50, a stopper piece 532 for stopping the leading end of a document sheet placed on the document feed tray 31 in the feeding direction and a pin 533 rotatably supporting the stopper piece 532 relative to the engaging portion 531. Note that the stopper piece 532 rests on the engaging portion 531 for clockwise rotation when viewed from front and is free to rotate only in a counterclockwise direction.

The stopper pieces 532 project to the downstream end 312 of the document feed tray 31 to restrict the leading end of a document sheet in the feeding direction as shown in FIG. 5 when the pickup roller 51 is at the retracted position. On the other hand, when the holder 50 pivots to bring the pickup roller 51 to the feeding position, the lower ends of the stopper pieces 532 are lifted to release restriction on the leading end of the document sheet in the feeding direction as the right end of the holder 50 is lowered. When a jam occurs during the conveyance of a document sheet and the user pulls out the document sheet in a direction opposite to the feeding direction, the stopper pieces 532 rotate counterclockwise about the pins 533. Thus, the pull-out of the document sheet is not blocked.

A first wheel 541 having a multitude of grooves formed in the outer circumferential surface is fixed to the rotary shaft of the pickup roller 51. Further, a second wheel 542 including similar grooves is fixed to the rotary shaft 521 of the document feed roller 52 (see FIG. 6). These first and second wheels 541, 542 are respectively arranged at positions behind the pickup roller 51 and the document feed roller 52. An endless belt 55 (transmission mechanism) for power transmission is mounted between the first and second wheels 541, 542. A multitude of projections engageable with the grooves of the first and second wheels 541, 542 are formed on the inner circumferential surface of the endless belt 55. When a rotational driving force in a direction to feed the document sheet (rotational driving force in a forward direction; rotational driving force in a clockwise direction when viewed from front) is given to the rotary shaft 521 of the document feed roller 52, this rotational driving force is transmitted to the rotary shaft of the pickup roller 51 via the endless belt 55. As a result, the pickup roller 51 and the document feed roller 52 are both rotated in synchronization. According to this construction, the pickup roller 51 can be rotated to feed the sheet utilizing the rotational driving force given to the rotary shaft 521. That is, a pivotal movement of the holder 50 and a rotational movement of the pickup roller 51 can be realized by the same driving system.

The driving mechanism 56 is a mechanism for transmitting the rotational driving force of the motor 7 (see FIG. 8) in the forward or reverse direction to the rotary shaft 521 of the document feed roller 52. The driving mechanism 56 includes a coupling portion 561, a shaft 562, a drive input portion 563 and a pressure spring 564.

The coupling portion 561 is a part to be engaged with the rotary shaft 521 and the shaft 562 and has a tubular shape for receiving the rotary shaft 521 and the shaft 562. A groove portion 561A extending in an axial direction of the rotary shaft 521 is formed in the tubular wall of the coupling portion 561. On the other hand, a pin 522 projects from the peripheral wall of the rotary shaft 521 and a pin 565 projects from the peripheral wall of the shaft 562, and the above engagement is achieved by fitting these pins 522, 565 into the groove portion 561A. The pressure spring 564 biases the coupling portion 561 forward to make the engagement of the groove portion 561A with the pin 522 reliable.

A rotational driving force is given to the drive input portion 563 from the motor 7 via an unillustrated gear mechanism. The coupling portion 561, the shaft 562 and the drive input portion 563 are united, so that the coupling portion 561 rotates when the drive input portion 563 is rotated and a rotational driving force thereof is transmitted to the rotary shaft 521. This causes the pickup roller 51 and the document feed roller 52 to rotate.

A coiled part of the torsion coil spring 57 is inserted through a boss 571 integral to the rotary shaft 521 with a constant holding force, and the torsion coil spring 57 includes a forward-direction engaging portion and a reverse-direction engaging portion with the holder 50. The torsion coil spring 57 is a member which couples the holder 50 and the rotary shaft 521 like a spring clutch and has a function of transmitting a torque of the rotary shaft 521 to the holder 50 in the range where the pivotal movement of the holder 50 is not restricted while not transmitting the torque of the rotary shaft 521 to the holder 50 in a state where the pivotal movement of the holder 50 is restricted. Note that a torque limiter may also be used instead of this torsion coil spring 57.

When a rotational driving force in the forward direction is given to the rotary shaft 521, the torsion coil spring 57 rotates together with the rotary shaft 521 due to the above holding force and the forward-direction engaging portion thereof transmits the torque to the holder 50. As a result, the holder 50 rotates clockwise about the axial center of the rotary shaft 521 and the pickup roller 51 moves to the feeding position where it is in contact with the upper surface of a document sheet placed on the document feed tray 31. After the pickup roller 51 rests on the document feed tray 31, a winding force of the torsion coil spring 57 applied to the rotary shaft 521 is weakened and the rotary shaft 521 (boss 571) idly rotates relative to the torsion coil spring 57. This prevents the torque of the rotary shaft 521 from being transmitted to the holder 50 after the pickup roller 50 moves to the feeding position.

This same applies also when a rotational driving force in the reverse direction is applied to the rotary shaft 521. In this case, the reverse-direction engaging portion is engaged with the holder 50 to cause the holder 50 to rotate counterclockwise about the axial center of the rotary shaft 521. This causes the pickup roller 51 to move to the retracted position spaced upward from the upper surface of the document sheet. FIGS. 4 and 5 show a state where the pickup roller 51 is at the retracted position. A pivoting range of the holder 50 is limited to a space between the ceiling plate 320 of the upper cover unit 32U and the document feed tray 31. After the holder 50 rests on the ceiling plate 320 of the upper cover unit 32U, the rotary shaft 521 similarly comes to idly rotate relative to the torsion coil spring 57, wherefore the torque of the rotary shaft 521 is not transmitted to the holder 50 after the pickup roller 51 is moved to the retracted position. In this way, the holder 50 is maintained in a posture raised by the holding force of the torsion coil spring 57 for the boss 571 when the pickup roller 51 is at the retracted position. Therefore, when vibration is applied from the ceiling plate 320, the holder 50 may be possibly lowered.

With reference to FIG. 8, the detecting member 6 includes a probe 61, a coupling bar 62 and a light blocking piece 63. The coupling bar 62 is rotatably supported on a housing of the upper cover unit 32U, and the probe 61 is mounted on one end of the coupling bar 62 and the light blocking piece 63 is mounted on the other end. The probe 61 projects more toward the upstream side than the stoppers 53 at the downstream end 312 of the document feed tray 31. The light blocking piece 63 functions as a light blocking member of an unillustrated photointerrupter.

When a document sheet is placed on the document feed tray 31, the probe 61 is inclined by this document sheet. By this inclination, the coupling bar 62 rotates about an axis and the light blocking piece 63 also rotates. By the rotation of the light blocking piece 63, an optical path between a light emitting element and a light receiving element in the photointerrupter is blocked. Based on such a light blocking movement, placement of the document sheet on the document feed tray 31 can be detected.

Note that this embodiment shows that the probe 61 is disposed at more downstream portion than the pickup roller 51. Instead of this arrangement, the probe 61 may be disposed at more upstream portion than the pickup roller 51. In this modified embodiment, a detecting member corresponding to the probe 61 is provided on the side of the document feed tray 31. The modified embodiment has an advantage that, even the pickup roller 51 has been lowered by the vibration, a document sheet placed on the document feed tray 31 is surely detected by the detecting member.

The motor 7 generates a rotational driving force in the forward or reverse direction. A DC motor, a stepping motor or the like can be used as this motor.

The controller 8 is composed of a microcomputer with built-in storages such as a ROM storing, for example, a control program and a flash memory for temporarily storing data. The controller 8 controls the holder 50 to pivot in such a direction that the pickup roller 51 moves toward the retracted position when the detector 6 detects placement of a sheet.

Specifically, the controller 8 controls the operation of the motor 7. When the detecting member 6 detects placement of a document sheet on the document feed tray 31, the controller 8 causes the motor 7 to temporarily (e.g. 1 sec) generate a rotational driving force in the reverse direction and causes this rotational driving force to be applied to the drive input portion 563 to pivot the holder 50 in the direction that the pickup roller 51 moves toward the retracted position. Thereafter, to cause the pickup roller 51 to feed the sheet, the controller 8 causes the motor 7 to generate a rotational driving force in the forward direction and pivot the holder 50 so that the pickup roller 51 assumes the feeding position.

Figure 9:
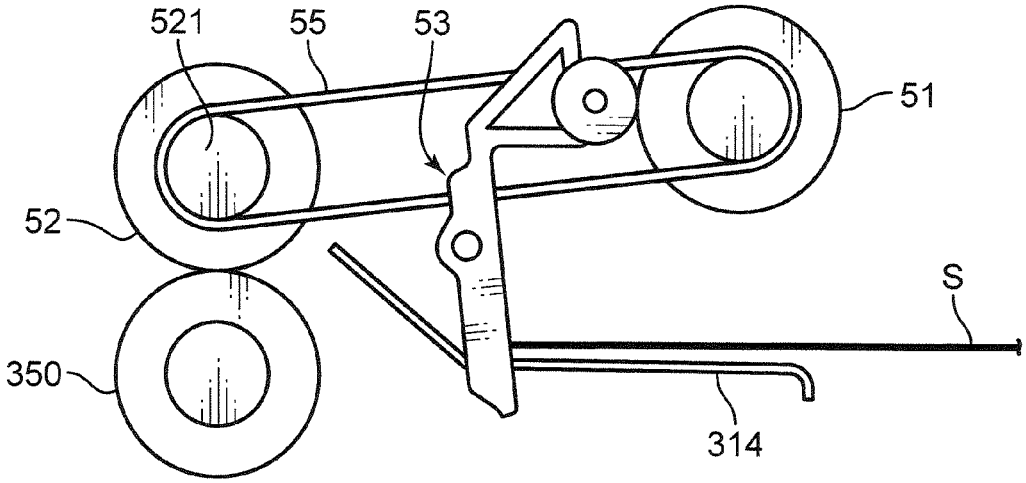
FIG. 9 is a diagram showing a state where a pickup roller is at a retracted position.
Figure 10:
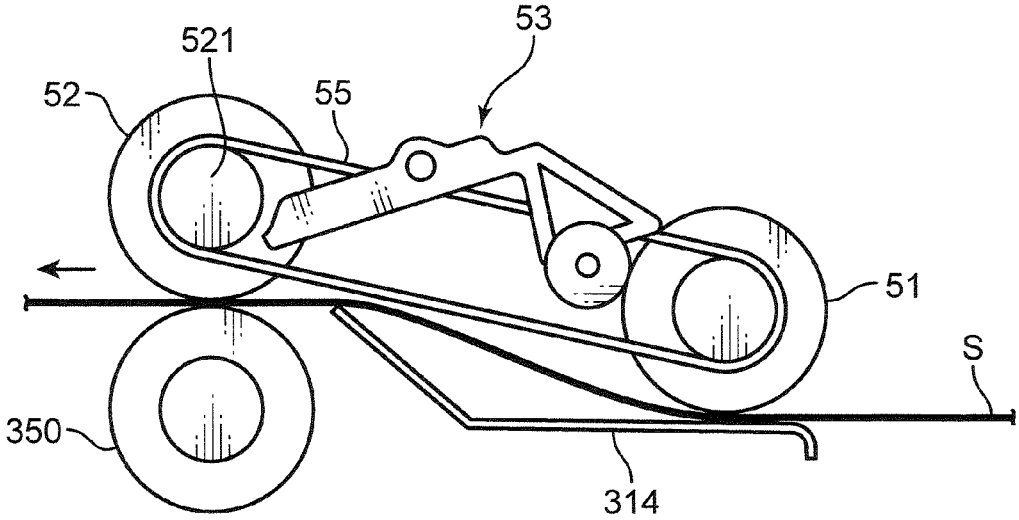
FIG. 10 is a diagram showing a state where the pickup roller is at a feeding position.
Figure 11:
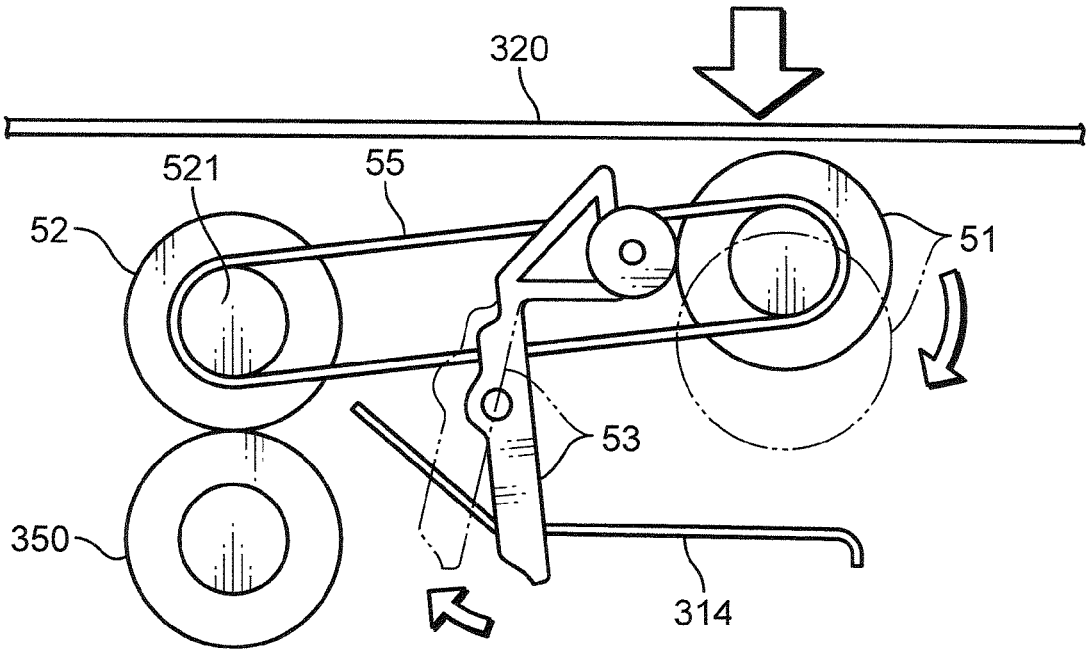
FIG. 11 is a diagram showing a behavior when vibration is applied to the pickup roller.

The reason why the controller 8 performs the above control is described with reference to FIGS. 9 to 11. FIGS. 9 and 10 are diagrams respectively showing the state where the pickup roller 51 is at the retracted position and the state where the pickup roller 51 is at the feeding position. Further, FIG. 11 is a diagram showing a behavior when vibration is applied to the pickup roller 51 (holder 50) at the retracted position via the ceiling plate 320 of the upper cover unit 32U.

At the retracted position of FIG. 9, the pickup roller 51 is retracted upward from a document sheet S and not in contact with the document sheet S. The leading end of the document sheet S in the conveying direction is restricted by the stoppers 53 and the document sheet S cannot enter the document conveying unit 32. Although not shown in FIG. 9, the holder 50 is rotated counterclockwise about the axis of the rotary shaft 521 and assumes an elevated posture. As described above, the holder 50 is maintained in such an elevated posture by the holding force of the torsion coil spring 57 for the boss 571.

When the controller 8 applies a rotational driving force in the forward direction (clockwise direction) to the rotary shaft 521 via the motor 7 in the state of FIG. 9, the forward-direction engaging portion of the torsion coil spring 57 and the holder 50 are engaged and coupled. This causes the holder 50 to rotate clockwise about the axis of the rotary shaft 521 and the pickup roller 51 moves to the feeding position as shown in FIG. 10. At the feeding position, the pickup roller 51 is in contact with the upper surface of the document sheet S. By the rotation of the pickup roller 51, the document sheet S is guided to the nip portion between the document feed roller 52 and the driven roller 350 by the guide 314 and enters the document conveying unit 32.

When the pickup roller 51 reaches the feeding position, the torsion coil spring 57 is loosened and the holding force of the torsion coil spring 57 for the boss 571 is released. Accordingly, in a lowered posture of the holder 50, a torque to pivot the holder 50 in the clockwise direction does not act. When the feed of the document sheet S is completed, a rotational driving force in the reverse direction (counterclockwise direction) is temporarily applied from the motor 7 to the rotary shaft 521. Then, the forward-direction engaging portion of the torsion coil spring 57 and the holder 50 are disengaged and the torsion coil spring 57 recovers the holding force for the boss 571. Subsequently, the reverse-direction engaging portion of the torsion coil spring 57 is engaged with the holder 50 and the holder 50 is lifted from the lowered posture to the elevated posture by the holding force. This causes the pickup roller 51 to move to the retracted position.

Here, the holding force of the torsion coil spring 57 is not set very strong. This is because of a problem that a rotational load of the rotary shaft 521 becomes excessive in a state where the holder 50 rests on the document feed tray 31 or the ceiling plate 320 when the holding force of the torsion coil spring 57 is set to be too strong. In this case, a large torque is necessary to rotate and drive the rotary shaft 521 and an expensive and large-size high-output motor needs to be used as the motor 7.

Thereafter, the pickup roller 51 is planed to be at the retracted position until the next document sheet S is fed. However, as shown in FIG. 11, the pickup roller 51 may be possibly lowered from the retracted position due to various factors. A main factor is vibration applied to the ceiling plate 320 of the upper cover unit 32U.

The user of the image forming apparatus 1 often aligns document sheets utilizing the ceiling plate 320 of the automatic document feeder 3 in setting the document sheets on the automatic document feeder 3. Vibration applied to the ceiling plate 320 by this aligning operation may be transmitted from the holder 50 held in contact with the ceiling plate 320 to rotate the holder 50 clockwise about the axis of the rotary shaft 521. This results from the fact that the torsion coil spring 57 holds the holder 50 with a relatively weak holding force and a force of constraint is weak as described above.

When the pickup roller 51 is lowered according to the clockwise rotation of the holder 50, the space where the document sheet S can be set is narrowed in the height direction, which causes a problem that the leading end of the document sheet S is rolled up when the document sheet S is set. Further, by the rotation of the holder 50, the stoppers 53 also rotate (see dotted line in FIG. 11) and the leading end of the document sheet S is not sufficiently restricted. As a result, the leading end of the document sheet S in the feeding direction may be inserted up to the vicinity of the nip portion between the document feed roller and the driven roller 50, which may cause multi-feed of the document sheets S.

To solve this problem, the controller 8 causes the motor 7 to generate a rotational driving force in the reverse direction and causes the holder 50 to pivot counterclockwise at the time of the first feeding operation of the document sheet S. The holder 50 is pivoted at a timing when the detecting member 6 detects placement of the document sheet S on the document feed tray 31. The detecting member 6 is located upstream of the stoppers 53 in the sheet conveying direction (inserting direction of the document sheet S). Accordingly, even if the pickup roller 51 and the stoppers 53 rotate as shown by dotted line in FIG. 11, they are returned to postures shown by solid line in FIG. 11 and the leading end of the document sheet S in the feeding direction can be restricted by the stoppers 53 before being inserted to the vicinity of the nip portion. According to this construction, only by controlling the direction of the rotational driving force applied to the drive input portion 563 of the rotary shaft 521, it is possible to control the position of the pickup roller 51, i.e. perform a control to pivot the holder 50 so that the pickup roller 51 moves toward the retracted position and thereafter pivot the holder 50 so that the pickup roller 51 assumes the feeding position. Further, since the pickup roller 51 can be moved toward the retracted position every time sheet feed is started, a state where restriction by the stoppers 53 acts can be recovered.

Thereafter, when the user instructs a copy operation using the operation panel unit 25 (input unit), the controller 8 causes the motor 7 to generate a rotational driving force in the forward direction. In this way, the holder 50 pivots clockwise and the pickup roller 51 and the document feed roller 52 rotate to feed the document sheet S toward the document conveying unit 32.

Figure 12:
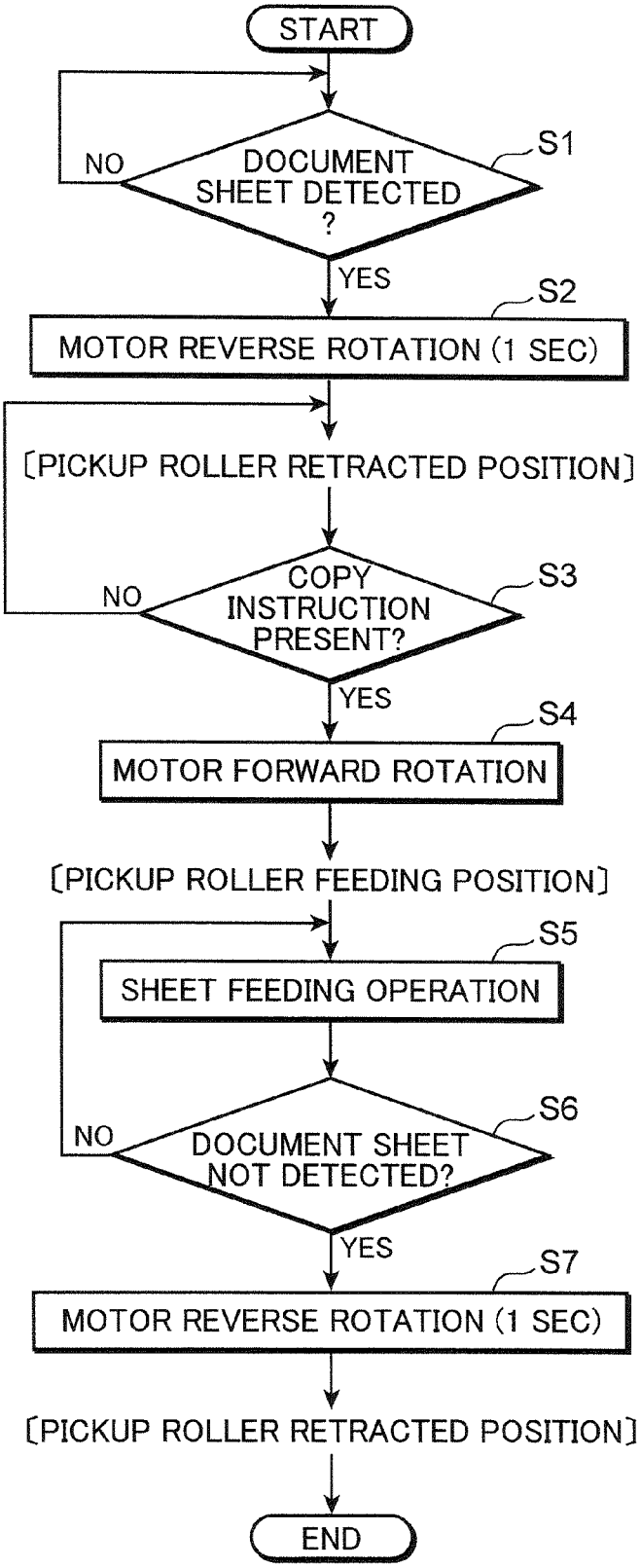
FIG. 12 is a flow chart showing the operation of a controller.

FIG. 12 is a flow chart showing the operation of the controller 8. The controller 8 waits until the detecting member 6 detects placement of a document sheet on the document feed tray 31 (Step S1). When the detecting member 6 detects the document sheet (YES in Step S1), the controller 8 causes the motor 7 to rotate in the reverse direction for a predetermined time (e.g. 1 sec) (Step S2). By this reverse rotation, the holder 50 is pivoted counterclockwise and the pickup roller 51 reaches the retracted position.

Thereafter, the controller 8 waits until the operation panel unit 25 receives a copy instruction (Step S3). When the copy instruction is given (YES in Step S3), the controller 8 causes the motor 7 to rotate in the forward direction (Step S4). By this forward rotation, the holder 50 is pivoted clockwise and the pickup roller 51 reaches the feeding position. Further, the pickup roller 51 and the document feed roller 52 rotate to feed the document sheet S to the document conveying unit 32 (Step S5).

The controller 8 monitors a sensing result of the detecting member 6 (Step S6) and the sheet feeding operation of Step S5 is continued until the detecting member 6 no longer detects placement of the document sheet. When the detecting member 6 no longer detects placement of the document sheet (YES in Step S6), it means that the feed of the document sheet S has been completed. Thus, the controller 8 causes the motor 7 to rotate in the reverse direction for a predetermined time (e.g. 1 sec) (Step S7). By this reverse rotation, the holder 50 is pivoted counterclockwise and the pickup roller 51 is returned to the retracted position.

According to the image forming apparatus 1 of this embodiment described above, the holder 50 is so pivoted that the pickup roller 51 moves toward the retracted position every time a document sheet is placed on the document feed tray 31. Accordingly, even if the pickup roller 51 is lowered from the retracted position against the holding force of the torsion coil spring 57 due to a certain factor such as a document sheet aligning operation by the user utilizing the ceiling plate 320, the pickup roller 51 returns to the retracted position when the document sheet is set. The stoppers 53 also return to proper positions. Thus, the user can reliably set the document sheet at a predetermined position.

As described above, according to this disclosure, it is possible to provide a sheet feeder and an image forming apparatus in which a sheet to be fed can be reliably set on a tray and fed at a predetermined position without problem.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeder, comprising:

a housing;

a tray which is attached to the housing and on which a sheet to be fed is to be placed;

a pickup roller for feeding a sheet on the tray to a predetermined processing position;

an arm member supported on the housing to be pivotal in a predetermined range and, on the other hand, rotatably supporting the pickup roller;

a rotary shaft supported on the housing to be rotatable about an axis thereof;

a coupling member which is a member for coupling the arm member and the rotary shaft and transmits a torque of the rotary shaft to the arm member in a range where a pivotal movement of the arm member is not restricted while not transmitting the torque of the rotary shaft to the arm member in a state where the pivotal movement of the arm member is restricted;

a pivoting mechanism for pivoting the arm member via the rotary shaft so that the pickup roller shifts its position between a feeding position where it is in contact with the upper surface of a sheet on the tray and a retracted position spaced upward from the upper surface of the sheet;

an input unit for receiving an instruction to perform the feeding operation of a sheet a controller for controlling the operation of the pivoting mechanism; and a detector for detecting placement of a sheet on the tray;

wherein the controller controls the arm member to pivot in such a direction that the pickup roller moves toward the retracted position when the detector detects placement of a sheet in a state before starting a feeding operation of the sheet, and thereafter, when the input unit receives instruction to perform the feeding operation, the controller controls the arm member to pivot in such a direction that the pickup roller moves toward the feeding position.

2. A sheet feeder according to claim 1, wherein:

the pivoting mechanism includes a driving mechanism for generating rotational driving forces in forward and reverse directions;

the rotary shaft includes a drive input portion to which a rotational driving force is applied from the driving mechanism; and the controller controls the arm member to pivot in such a direction that the pickup roller moves toward the retracted position by applying a rotational driving force in the reverse direction to the drive input portion when the detector detects placement of a sheet in a state before starting a feeding operation of the sheet and, thereafter, controls the arm member to pivot such that the pickup roller assumes the feeding position by applying a rotational driving force in the forward direction to the drive input portion when causing the pickup roller to feed the sheet after the input unit receives instruction to perform the feeding operation.

3. A sheet feeder according to claim 2, further comprising a transmission mechanism for transmitting a rotational driving force to the pickup roller via the rotary shaft and rotating the pickup roller to feed the sheet when the rotational driving force in the forward direction is applied to the drive input portion.

4. A sheet feeder according to claim 3, further comprising a feed roller mounted on the rotary shaft so as to be able to integrally rotate about the axis of the rotary shaft, wherein:

the arm member rotatably supports both the pickup roller and the feed roller.

5. A sheet feeder according to claim 1, wherein:

the housing includes a ceiling plate located above the arm member; and the arm member rests on the ceiling plate and has the pivotal movement thereof restricted when the pickup roller moves toward the retracted position and rests on the tray and has the pivotal movement thereof restricted when the pickup roller moves toward the feeding position.

6. A sheet feeder according to claim 1, further comprising a stopper for restricting the leading end of a sheet placed on the tray in a feeding direction, wherein:

the stopper projects into a feeding path for the sheet and restricts the leading end of the sheet in the feeding direction when the pickup roller is at the retracted position and is retracted from the feeding path for the sheet when the pickup roller is at the feeding position.

7. An image forming apparatus, comprising:

an image reading unit for optically reading a document image of a document sheet;

an image forming unit for performing an image forming process for the document image on a recording sheet;

an input unit for receiving an instruction to perform the image forming process for the image forming unit; and an automatic document feeder for automatically feeding the document sheet to the image reading unit;

wherein the automatic document feeder includes;

a housing;

a document tray which is attached to the housing and on which a document sheet to be fed is to be placed;

a pickup roller for feeding a document sheet on the document tray to an image reading position;

an arm member rotatably supporting the pickup roller;

a rotary shaft supported on the housing to be rotatable about an axis thereof;

a coupling member which is a member for coupling the arm member and the rotary shaft and transmits a torque of the rotary shaft to the arm member in a range where a pivotal movement of the arm member is not restricted while not transmitting the torque of the rotary shaft to the arm member in a state where the pivotal movement of the arm member is restricted;

a pivoting mechanism for pivoting the arm member so that the pickup roller shifts its position between a feeding position where it is in contact with the upper surface of a document sheet on the tray and a retracted position spaced upward from the upper surface of the document sheet;

a controller for controlling the operation of the pivoting mechanism; and a detector for detecting placement of a document sheet on the document tray;

the controller controlling the arm member to pivot in such a direction that the pickup roller moves toward the retracted position when the detector detects placement of a sheet in a state before starting a feeding operation of the document sheet, and thereafter, when the input unit receives instruction to perform the image forming process, the controller controls the arm member to pivot in such a direction that the pickup roller moves toward the feeding position.

8. An image forming apparatus according to claim 7, wherein:

the pivoting mechanism includes a driving mechanism for generating rotational driving forces in forward and reverse directions;

the rotary shaft includes a drive input portion to which a rotational driving force is applied from the driving mechanism; and the controller controls the arm member to pivot in such a direction that the pickup roller moves toward the retracted position by applying a rotational driving force in the reverse direction to the drive input portion when the detector detects placement of the document sheet in a state before starting a feeding operation of the document sheet and, thereafter, controls the arm member to pivot such that the pickup roller assumes the feeding position by applying a rotational driving force in the forward direction to the drive input portion when the input unit receives an instruction to perform the image forming process.

* * * * *